US010715919B2

(12) United States Patent
Xiao

(10) Patent No.: US 10,715,919 B2
(45) Date of Patent: Jul. 14, 2020

(54) ACOUSTIC DEVICE

(71) Applicant: AAC Technologies Pte. Ltd., Singapore (SG)

(72) Inventor: Bo Xiao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/233,500

(22) Filed: Dec. 27, 2018

(65) Prior Publication Data

US 2019/0230441 A1 Jul. 25, 2019

(30) Foreign Application Priority Data

Jan. 24, 2018 (CN) ..... 2018 2 0126148 U

(51) Int. Cl.

| | |
|---|---|
| ***H04R 9/00*** | (2006.01) |
| ***H04R 9/02*** | (2006.01) |
| ***H04R 9/04*** | (2006.01) |
| ***H04R 1/02*** | (2006.01) |
| ***H04R 7/02*** | (2006.01) |
| ***H04R 9/06*** | (2006.01) |

(52) U.S. Cl.

CPC ..... *H04R 9/025* (2013.01); *H04R 1/02* (2013.01); *H04R 7/02* (2013.01); *H04R 9/046* (2013.01); *H04R 9/06* (2013.01); *H04R 2400/11* (2013.01); *H04R 2499/11* (2013.01)

(58) Field of Classification Search

CPC ..... H04R 2440/00–07; H04R 9/00; H04R 29/003; H04R 2209/00; H04R 2209/41; H04R 9/025; H04R 9/027

USPC ..... 381/152, 396, 400, 404, 412

See application file for complete search history.

(56) References Cited

U.S. PATENT DOCUMENTS

| | | | | |
|---|---|---|---|---|
| 6,389,148 | B1 * | 5/2002 | Yoo | H04R 11/02 381/417 |
| 2014/0301578 | A1 * | 10/2014 | Lee | H04R 1/021 381/122 |
| 2014/0355806 | A1 * | 12/2014 | Graff | H04R 1/025 381/334 |
| 2015/0055818 | A1 * | 2/2015 | Chen | H04R 9/041 381/400 |
| 2016/0127835 | A1 * | 5/2016 | Jiang | H04R 9/063 381/398 |

* cited by examiner

*Primary Examiner* — Suhan Ni

(74) *Attorney, Agent, or Firm* — IPro, PLLC; Na Xu

(57) ABSTRACT

The present disclosure provides an acoustic device, including a frame and a vibration system and a magnetic circuit system respectively fixed to the frame. The vibration system includes an FPC configured to support and fix the voice coil, where the FPC includes a first fixing arm and a second fixing arm arranged at an interval and an elastic arm configured to connect the first fixing arm and the second fixing arm; and the magnetic circuit system includes a magnetic yoke fixed to the frame, a magnet fixed to the magnetic yoke, and a magnetic frame flange that is bent and extends from a periphery of the magnetic yoke, and the magnetic frame flange is inserted in a gap between the voice coil and the elastic arm. Compared with the related art, the acoustic performance of the acoustic device of the present disclosure is optimal.

9 Claims, 3 Drawing Sheets

ACOUSTIC DEVICE

CROSS-REFERENCE TO RELATED APPLICATIONS

This application claims the priority benefit of Chinese Patent Application Ser. No. 201820126148.3 filed on Jan. 24, 2018, the entire content of which is incorporated herein by reference.

TECHNICAL FIELD

The present disclosure relates to the acoustoelectric field, and in particular, to an acoustic device used in a portable electronic product.

BACKGROUND

With the advent of the era of mobile internet, a quantity of smart mobile apparatuses is continuously increasing. Among multiple mobile apparatuses, a mobile phone is undoubtedly a most common and portable mobile terminal apparatus. Acoustic devices such as speakers and receivers for playing sounds are now widely used in smart mobile apparatuses such as mobile phones.

A vibration system and a magnetic circuit system used in an acoustic device directly determine a sound quality of the acoustic device. To enhance a stability of the vibration system, a vibration system of a micro acoustic device of the related art includes: a first vibrating diaphragm fixed to a frame, a voice coil configured to drive the first vibrating diaphragm to vibrate and produce a sound, and a second vibrating diaphragm configured to enhance a transverse stability of the voice coil. The magnetic circuit system includes a magnetic yoke and a magnet fixed to the magnetic yoke.

The second vibrating diaphragm is supported on and fixed to an FPC. The FPC is configured to connect a voice coil lead wire to introduce an electric signal. The FPC includes a first fixing arm fixed to a frame, a second fixing portion fixed to one end of the voice coil away from the first vibrating diaphragm, and an elastic arm connected to the first fixing portion and the second fixing portion. Two opposite sides of the second vibrating diaphragm are fixed to the first fixing arm and the second fixing arm, respectively.

However, in the acoustic device of the related art, due to the structural restriction of the second vibrating diaphragm, there is not a structure, between the elastic arm of the FPC and the voice coil, for blocking magnetic induction lines, resulting in a leakage of the magnetic induction lines, so that an acoustic performance of the acoustic device cannot be improved and the acoustic performance of the acoustic device is restricted.

Therefore, it is indeed necessary to provide a novel acoustic device to resolve the foregoing technical problem.

BRIEF DESCRIPTION OF THE DRAWINGS

To illustrate the technical schemes in the embodiments of the present disclosure, the following briefly describes the accompanying drawings required for describing the embodiments. Apparently, the accompanying drawings in the following description merely show some embodiments of the present disclosure, and persons of ordinary skill in the art can derive other drawings from these accompanying drawings without creative efforts.

DETAILED DESCRIPTION

The following clearly and completely describes the technical solutions in the embodiments of the present disclosure with reference to the accompanying drawings in the embodiments of the present disclosure. Apparently, the described embodiments are merely a part rather than all of the embodiments of the present disclosure. All other embodiments obtained by a person skilled in the art based on the embodiments of the present disclosure without creative efforts shall fall within the protection scope of the present disclosure.

Figure 1:
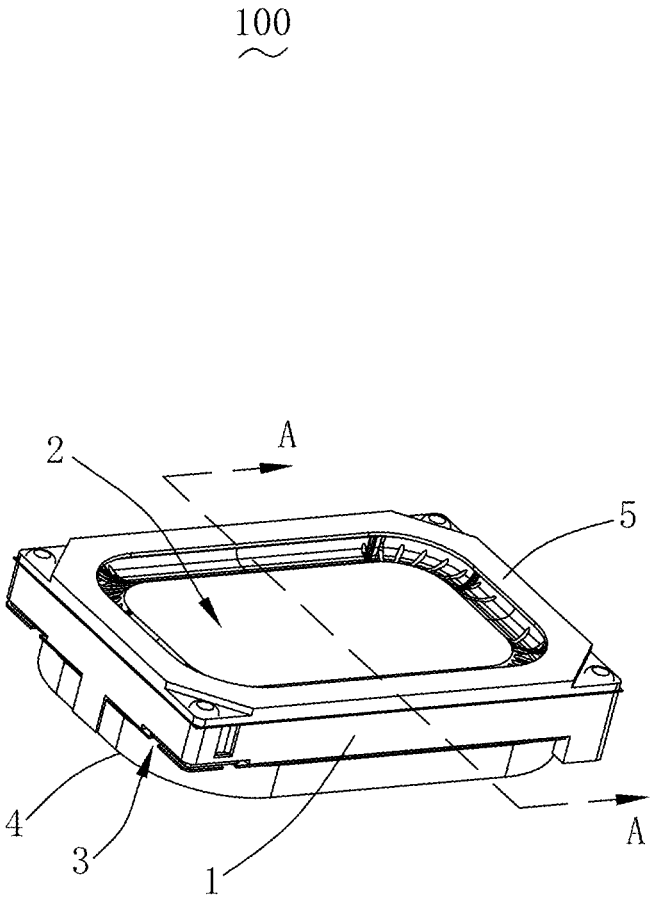
FIG. 1 is a three-dimensional schematic structural diagram of an acoustic device of the present disclosure.
Figure 2:
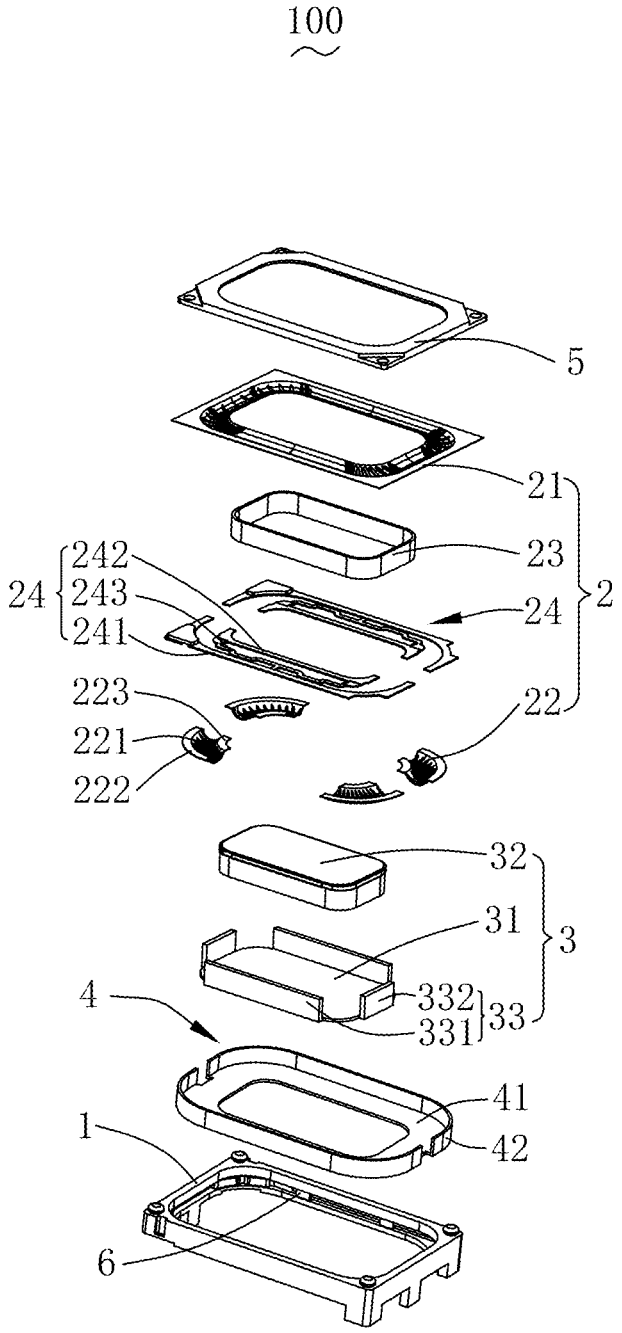
FIG. 2 is a three-dimensional exploded view of a part of an acoustic device of the present disclosure.
Figure 3:
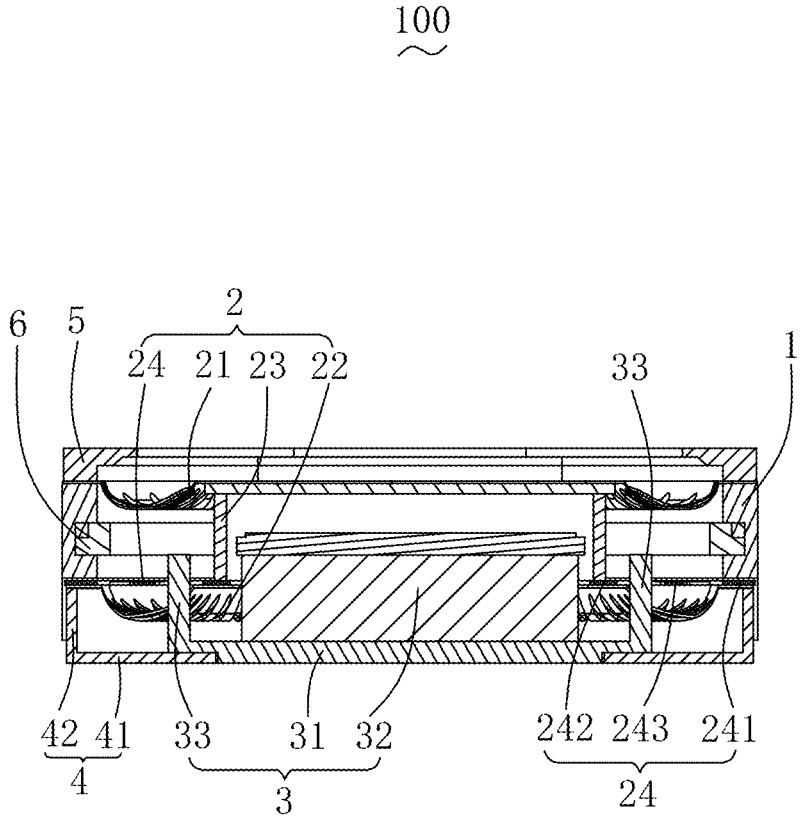
FIG. 3 is a cross-sectional view along line A-A in FIG. 1.

Referring to FIG. 1 to FIG. 3, the present disclosure provides an acoustic device 100, including a frame 1, a vibration system 2, a magnetic circuit system 3 configured to drive the vibration system 2 to vibrate, a magnetic frame sealing cap 4, a front cover 5 covering the frame 1, and a reinforcing rib 6.

The frame 1 is configured to fix and support the vibration system 2 and the magnetic circuit system 3. The frame 1 may be in a round shape, a rectangular shape, or the like. The frame, as an example, in a rectangular shape is used in this implementation for description.

To reduce a volume of the frame 1, a reinforcing rib 6, for example, made of stainless steel, in a ring shape may be embedded in the frame, by which not only the strength of the frame 1 can be enhanced, thereby improving the reliability, but also the volume of the frame 1 is enabled to become smaller, thereby saving space and optimizing the magnetic circuit system 3.

The vibration system 2 includes a first vibrating diaphragm 21 and a second vibrating diaphragm 22 respectively fixed to the frame 1, a voice coil 23 configured to drive the first vibrating diaphragm 21 to vibrate and produce a sound, and an FPC 24 configured to support and fix the second vibrating diaphragm 22.

The first vibrating diaphragm 21 is configured to vibrate and produce a sound. The voice coil 23 is fixed to the first vibrating diaphragm 21, thereby forming a suspension.

The second vibrating diaphragm 22 is fixed to an end of the voice coil 23 away from the first vibrating diaphragm 21. In this implementation, four second vibrating diaphragms 22 are arranged at intervals. Certainly, a quantity of the second vibrating diaphragms 22 is not limited herein.

To further enhance the vibration stability and reliability of the acoustic device 100, in this implementation, four second vibrating diaphragms 22 are arranged at intervals. The four second vibrating diaphragms 22 are arranged symmetrically and in sections in structure. On one hand, the space is saved, and on the other hand, an anti-swing performance of the voice coil 23 is strengthened and the acoustic performance and reliability of the acoustic device 100 are improved.

Specifically, the second vibrating diaphragm 22 includes an arc-shaped vibration portion 221, a first fixing portion 222, and a second fixing portion 223. The first fixing portion 222 and the second fixing portion 223 extend from two opposite sides of the vibration portion 221 and are fixed to the frame 1 and the voice coil 23, respectively.

The voice coil 23 is electrically connected to the FPC 24.

The FPC 24 supports and fixes the voice coil 23, for example, the FPC 24 fixes the voice coil 23 by being fixed to the second vibrating diaphragm 22. In this implementation, every two of the second vibrating diaphragms 22 are fixed to two opposite ends of the same FPC 24.

More preferably, the two FPCs 24 are arranged in parallel to a long axis of the frame 1, respectively, and the four second vibrating diaphragms 22 are located at four corners of the frame 1, respectively.

Specifically, the FPC 24 includes a first fixing arm 241 and a second fixing arm 242 arranged at an interval and an elastic arm 243 configured to connect the first fixing arm 241 and the second fixing arm 242. The first fixing arm 241 is fixed to the frame 1. The second fixing arm 242 is fixed to an end of the voice coil 23 away from the first vibrating diaphragm 21. More preferably, the voice coil 23 is electrically connected to the second fixing arm 242.

In this implementation, the first fixing arm 241 is arranged in parallel to the second fixing arm 242. The elastic arm 243 is arranged substantially parallel to the first fixing arm 241 or the second fixing arm 242, and at an interval with the first fixing arm 241 or the second fixing arm 242, to form a gap.

The first fixing portion 222 of the second vibrating diaphragm 22 is fixed to the first fixing arm 241, the second fixing portion 223 is fixed to the second fixing arm 242, and the vibration portion 221 and the elastic arm 243 are arranged at an interval. That is, the second vibrating diaphragm 22 is fixed to the frame 1 through the FPC 24 and forms a support for the voice coil 23.

In the foregoing structure, on one hand, a voice coil lead wire structure is replaced with the FPC 24 and the voice coil 23 is directly connected to an external power supply, so that the problem of low reliability of the acoustic device 100 caused by break risks of the voice coil lead wire is avoided; and on the other hand, the second vibrating diaphragm 22 prevents vibration and swing of the voice coil 23 and strengthens the vibration performance of the vibration system 2, so that the acoustic performance of the acoustic device 100, such as the acoustic strength, becomes optimal and the stability becomes better.

In this implementation, specifically, two FPCs 24 are arranged at an interval, and the two FPCs 24 are disposed around the magnetic circuit system 3.

The magnetic circuit system 3 includes a magnetic yoke 31 fixed to the frame 1, a magnet 32 fixed to the magnetic yoke 31, and a magnetic frame flange 33 that is bent and extends from a periphery of the magnetic yoke 31 toward the second vibrating diaphragm 22. The magnetic frame flange 33 is inserted in a gap between the voice coil 23 and the elastic arm 243.

In this implementation, the magnetic frame flange 33 includes two first flanges 331 disposed corresponding to the two FPCs 24, respectively, and two second flanges 332 disposed at two opposite sides of the magnetic yoke 31 in a short axis direction of the frame 1, and the second flanges 332 and the first flanges 331 are disposed at intervals alternately.

The arrangement of the magnetic frame flange 33 forms a block for the magnetic induction lines generated by the magnet 32, to effectively prevent leakage of the magnetic induction lines, thereby improving the magnetic performance of the magnetic circuit system 3 and optimizing the acoustic performance of the acoustic device 100. Meanwhile, the magnetic frame flange 33 is inserted between the elastic arm 243 of the FPC 24 and the voice coil 23, so that the anti-swing effect on the voice coil 23 by the FPC 24 and the second vibrating diaphragm 22 is not affected.

The magnetic frame sealing cap 4 fixes the magnetic circuit system 3 to the frame 1. Specifically, the magnetic frame sealing cap 4 includes a bottom wall 41 and a side wall 42 that is in a ring shape and is bent and extends from a periphery of the bottom wall 41, the side wall 42 is fixed to the frame 1, and the magnetic yoke 31 is supported on and fixed to the bottom wall 41. For example, in this implementation, the magnetic yoke 31 is fixed to the bottom wall 41 by laser spot welding. Therefore, the magnetic circuit system 3 is fixed to the frame 1 through the magnetic frame sealing cap 4.

The stainless steel material of the magnetic frame sealing cap 4 helps reduce rear cavity leakage of the acoustic device 100 and leakage of the magnetic induction lines, to optimize the acoustic performance of the acoustic device 100, and meanwhile plays a role of connecting the frame 1 and the magnetic circuit system 3.

The front cover 5 and the first vibrating diaphragm 21 are disposed opposite to each other to form a sound passage, configured to produce a sound.

The reinforcing rib 6 is in a ring shape and is embedded in the frame 1, to enhance the structural strength of the frame 1.

Compared with the related art, in the acoustic device of the present disclosure, the transverse stability of the voice coil is ensured by using a combined structure of the second vibrating diaphragm and the FPC, and by forming the magnetic frame flange which is bent and extended from the periphery of the magnetic yoke and inserting the magnetic frame flange in the gap between the elastic arm of the FPC and the voice coil, the magnetic frame flange effectively prevents the magnetic induction lines generated by the magnet from leaking while not affecting working of the second vibrating diaphragm and the FPC, thereby increasing the performance of the magnetic circuit system and effectively improving the acoustic performance of the acoustic device.

The above descriptions are only implementation manners of the present disclosure, and it should be noted that persons of ordinary skill in the art may further make improvements therefor without departing from the inventive concept of the present disclosure. However, these improvements fall within the protection scope of the present disclosure.

What is claimed is:

1. An acoustic device, comprising a frame and a vibration system and a magnetic circuit system respectively fixed to the frame, wherein the vibration system comprises a first vibrating diaphragm fixed to the frame, a voice coil configured to drive the first vibrating diaphragm to vibrate and produce a sound, and an FPC configured to support and fix the voice coil, wherein the FPC comprises a first fixing arm and a second fixing arm arranged at an interval and an elastic arm configured to connect the first fixing arm and the second fixing arm, the first fixing arm is fixed to the frame, and the second fixing arm is fixed to an end of the voice coil away from the first vibrating diaphragm; and the magnetic circuit system comprises a magnetic yoke fixed to the frame and a magnet fixed to the magnetic yoke, wherein the magnetic circuit system further comprises a magnetic frame flange that is bent and extends from a periphery of the magnetic yoke and the magnetic frame flange is inserted in a gap between the voice coil and the elastic arm.

2. The acoustic device according to claim 1, wherein the vibration system further comprises a second vibrating diaphragm elastically supporting the voice coil.

3. The acoustic device according to claim 2, wherein the second vibrating diaphragm comprises an arc-shaped vibration portion and a first fixing portion and a second fixing portion respectively extending from two opposite sides of the vibration portion, the first fixing portion is fixed to the first fixing arm, the second fixing portion is fixed to the second fixing arm, and the vibration portion and the elastic arm are arranged at an interval.

4. The acoustic device according to claim 2, wherein there are two FPCs arranged at an interval, the two FPCs are disposed around the magnetic circuit system, and the magnetic frame flange comprises two first flanges disposed corresponding to the two FPCs, respectively.

5. The acoustic device according to claim 4, wherein there are four second vibrating diaphragms and every two of the second vibrating diaphragms are fixed to two opposite ends of a same FPC, respectively.

6. The acoustic device according to claim 4, wherein the frame is in a rectangular shape, the two FPCs are disposed along a long axis of the frame, respectively, and the second vibrating diaphragms are located at four corners of the frame, respectively.

7. The acoustic device according to claim 6, wherein the magnetic frame flange further comprises second flanges disposed at two opposite sides of the magnetic yoke in a short axis direction of the frame.

8. The acoustic device according to claim 1, wherein the acoustic device further comprises a reinforcing rib in a ring shape and embedded in the frame.

9. The acoustic device according to claim 1, wherein the acoustic device further comprises a magnetic frame sealing cap configured to fix the magnetic circuit system to the frame, the magnetic frame sealing cap comprises a bottom wall and a side wall that is in a ring shape and is bent and extends from a periphery of the bottom wall, the side wall is fixed to the frame, and the magnetic yoke is fixed to the bottom wall.

* * * * *